US007451500B2

(12) United States Patent
Baker, Jr. et al.

(10) Patent No.: US 7,451,500 B2
(45) Date of Patent: Nov. 18, 2008

(54) SKIMMER DOOR ASSEMBLY

(75) Inventors: Darrell L. Baker, Jr., Mansfield, OH (US); Mark P. Fowler, Mansfield, OH (US)

(73) Assignee: Conceptual Plastic Creations, LLC, Crestline, OH (US)

( * ) Notice: Subject to any disclaimer, the term of this patent is extended or adjusted under 35 U.S.C. 154(b) by 0 days.

(21) Appl. No.: 11/435,516

(22) Filed: May 17, 2006

(65) Prior Publication Data

US 2006/0260035 A1 Nov. 23, 2006

Related U.S. Application Data

(60) Provisional application No. 60/682,068, filed on May 18, 2005.

(51) Int. Cl.
*E04H 4/00* (2006.01)

(52) U.S. Cl. ..... 4/507; 4/496

(58) Field of Classification Search ..... 4/507–509, 4/512, 496, 490, 504; 220/241; 210/416.2
See application file for complete search history.

(56) References Cited

U.S. PATENT DOCUMENTS

| | | | | |
|---|---|---|---|---|
| 4,913,810 | A | 4/1990 | Hodak | |
| 5,285,538 | A | 2/1994 | Hodak | |
| 5,937,453 | A * | 8/1999 | Hodak et al. | |
| 7,011,747 | B2 * | 3/2006 | Hodak | 210/167.12 |
| 7,029,178 | B2 | 4/2006 | Gzybowski | |
| 2005/0087482 | A1 | 4/2005 | Hodak | |

* cited by examiner

*Primary Examiner*—Huyen Le
(74) *Attorney, Agent, or Firm*—Fay Sharpe LLP

(57) ABSTRACT

A skimmer door assembly for use with a skimmer having an opening therein, having a face plate for matingly engaging the skimmer around the opening of the skimmer. The face plate has an opening therein which communicates with the opening of the skimmer. A raised rib portion extends around a periphery of the opening of the face plate. A cover has a first, planar wall which closes the opening of the face plate. The cover has a groove formed on the planar wall which engages the rib of the face plate for sealing the face plate to prevent water from entering the opening of the face plate.

17 Claims, 5 Drawing Sheets

SKIMMER DOOR ASSEMBLY

CLAIM OF PRIORITY

This application claims priority from Provisional Application No. 60/682,068, filed on May 18, 2005.

BACKGROUND

The present invention relates generally to swimming pools or spas and, more particularly, to a skimmer door assembly which seals and closes off the sidewall opening of a pool skimmer to prevent water from entering the skimmer during the off-season when the pool is closed.

Skimmer devices are used in the sidewalls of swimming pools, whirlpools, hot tubs, spas, etc. to allow surface water to be drawn off by a pump, filtered, and then returned to the pool through a return port. When the pool is closed during the off-season, it is often preferred to maintain a level of water in the pool for structural purposes. In such cases, it is necessary to close off the skimmer to prevent back flow of water through the skimmer conduit to the filtration equipment so as to prevent damage to the pipes and filtration equipment due to freezing during the cold winter months.

Existing systems sometimes employ a cover plate and a gasket frame fitted between the sidewall and cover. It is necessary to physically remove the skimmer face plate from the skimmer and pool sidewall in order to install the gasket frame therebetween. This requires extra labor and expense which may cause the average swimming pool owner to choose not to employ such a system. The plate may also cause leakage if not properly installed.

The present invention overcomes the above-mentioned deficiencies in prior skimmer sealing devices by providing a skimmer door which is much simpler and, less expensive than prior skimmer door designs. The skimmer door of the present invention does not require the extra gasket frame and is much more reliable and easier to install. Furthermore, the cover plate of the present invention cooperates with the face plate of the skimmer with a single track seal to provide a much better seal. The skimmer cover door is easy to install and slides and mounts easily with respect to the skimmer plate, unlike other skimmer doors which snap onto a plate, such as shown in U.S. Pat. No. 5,285,538, which is hereby incorporated by reference. The door is suitable for use as original equipment used when the pool is initially built, or it can be easily retrofitted into an existing pool construction.

Thus, it is considered desirable to provide a skimmer door assembly which overcomes the above-mentioned difficulties and others while providing a better, more advantageous result.

SUMMARY OF THE INVENTION

In accordance with one aspect of the present invention, a skimmer door assembly for use with an associated skimmer has an opening therein, has a face plate for matingly engaging the skimmer around the opening of the skimmer. The face plate has an opening therein which communicates with the opening of the skimmer, and a raised rib portion extending around a periphery of the opening of the face plate. A cover has a first, planar wall which closes the opening of the face plate. The cover further has a groove extending from the planar wall which engages the rib of the face plate for sealing the face plate to prevent water from entering the opening of the face plate.

In accordance with another aspect of the invention, a skimmer and door assembly has a skimmer body having an inlet on one end and an outlet on a second end. A skimmer face plate has a frame with an opening therein which communicates with the inlet of the skimmer body. A cover plate selectively covers the opening of the face plate and the inlet of the skimmer body. The cover plate and the face plate include a single track sealing interface formed inwardly of a peripheral edge of the cover plate and a peripheral edge of the face plate.

In accordance with yet another aspect of the invention, a method of sealing an opening of a skimmer assembly used with a swimming pool or spa, includes the steps of: providing a face plate having a rib extending around a central opening within the face plate; attaching the face plate to an inner wall of a swimming pool or spa; providing a cover plate having a groove extending inwardly from a peripheral edge of the cover plate; and, manually pressing the rib of the face plate into the groove of the cover plate to seal the face plate central opening.

Yet another aspect of the present invention is the provision of a cover plate which seals a skimmer of a swimming pool or spa to prevent water from entering the skimmer.

Another aspect of the present invention is the provision of a cover plate having a groove portion formed inwardly of a peripheral edge of the cover plate to seal the face plate and skimmer.

Yet another aspect of the present invention is the provision of providing a cover plate which seals a face plate without the need for a separate gasket.

Still another aspect of the present invention is the provision of a cover plate and face plate which form a single track seal interface similar to a zip lock seal.

Still other aspects of the present invention will become apparent after reading the following detailed description.

BRIEF DESCRIPTION OF THE DRAWINGS

Further aspects of the invention will become apparent by reference to the detailed description when considered in conjunction with the Figures, wherein like reference numbers indicate like elements through the several views, and wherein.

DETAILED DESCRIPTION OF THE EMBODIMENTS

Figure 1:
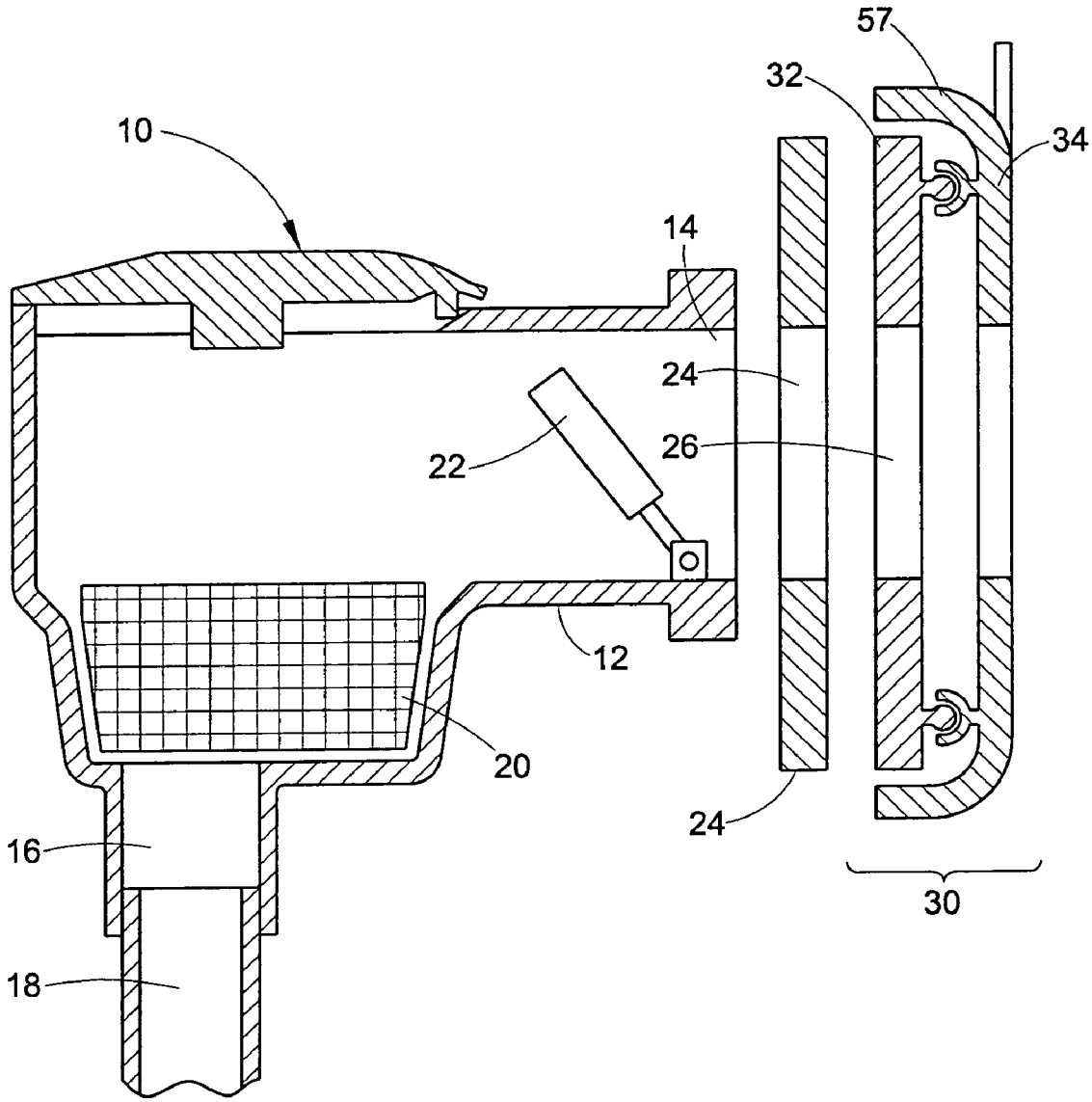
FIG. 1 is a side elevational exploded view of a skimmer mounted in a swimming pool sidewall, with a skimmer face plate and a cover in accordance with an embodiment of the present invention.

Referring now to the drawings, FIG. 1 depicts a swimming pool skimmer assembly 10, which is well known in the art, for drawing off surface water from a pool, hot tub, spa, etc. for filtration and possible heating purposes. The assembly 10 includes a body 12, having an open interior. The skimmer body has an open inlet 14 on one side of the interior communicating with the swimming pool and an outlet 16 at a lower region of the interior. The skimmer outlet 16 is attached to a conduit 18 which carries the pool water from the skimmer to the filtration pump and possibly a heater apparatus for return to the pool after treatment, in a manner well-known in the art. The skimmer assembly also contains a conventional strainer basket 20 and a buoyant weir 22.

The skimmer assembly is installed at an exterior or outboard side of a sidewall 24 of the swimming pool or spa. The sidewall 24 has an opening 26 formed therein which corresponds to the opening at the skimmer inlet.

Figure 2:
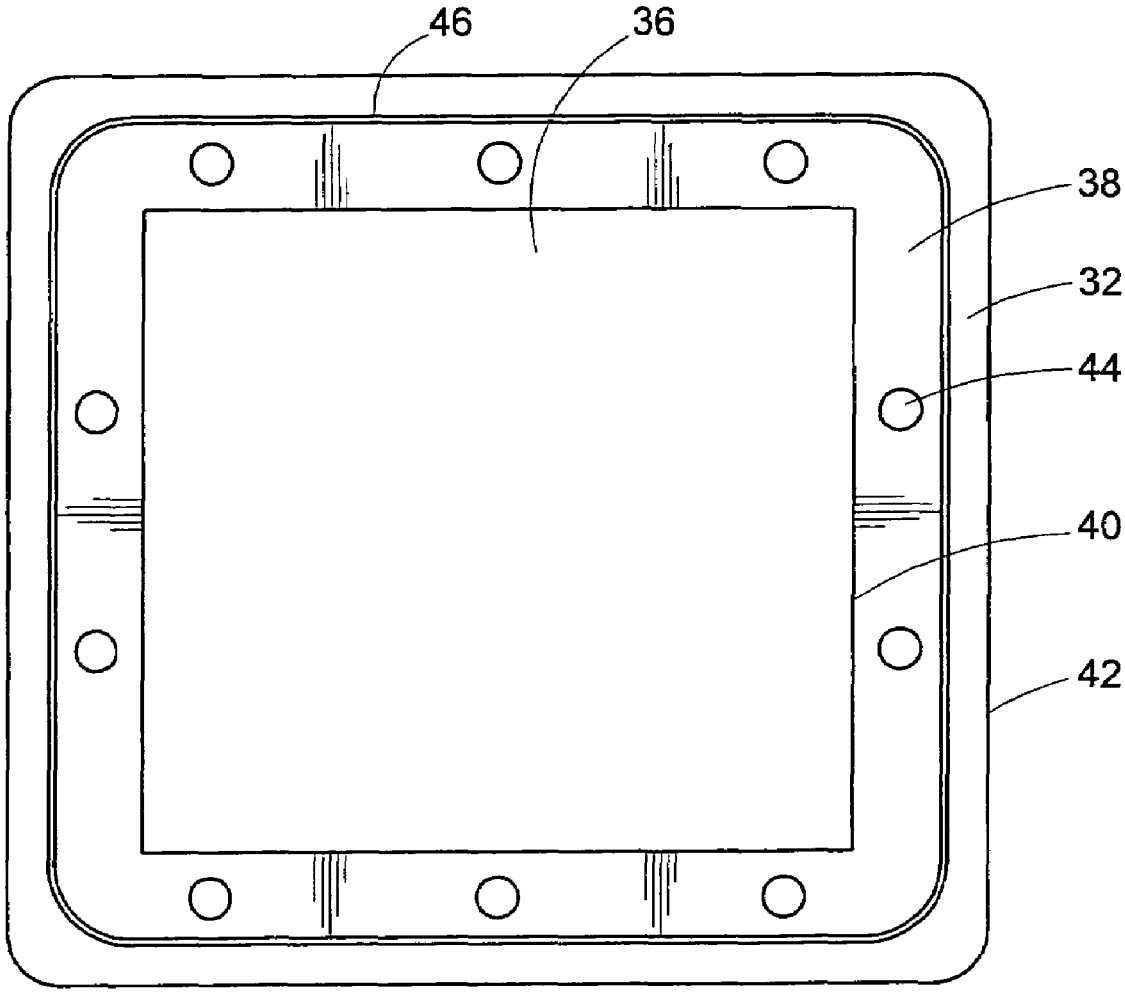
FIG. 2 is a front elevational view of the skimmer plate of FIG. 1.

A skimmer door assembly 30 in accordance with the present invention includes a skimmer face plate 32 and a mating cover 34. Referring now to FIG. 2, the skimmer plate has a frame-like shape having an opening 36 therein for communicating with the inlet of the skimmer. The plate is fabricated from a rigid, plastic material, such as thermoplastic. The face plate has a flat border area or planar wall 38 surrounding opening 36 and laterally extending from sidewall 40 of the opening to peripheral edges 42 of the plate. The plate also has a plurality of openings 44 formed through the border area 32 to permit attachment to the inlet of the skimmer on the wet or inboard side of the pool or spa sidewall via fasteners such as screws or bolts (not shown). A raised ribbed portion 46 is disposed on wall 38 and extends around the periphery of central opening 36 from wall 38 of the face plate. The ribbed portion 46 is shown in FIG. 2 to be formed along opening 36 in a track of a generally square formation. However, other shapes of the track of the ribbed portion, such as rectangular or round could be used without departing from the scope of the invention.

Figure 3:
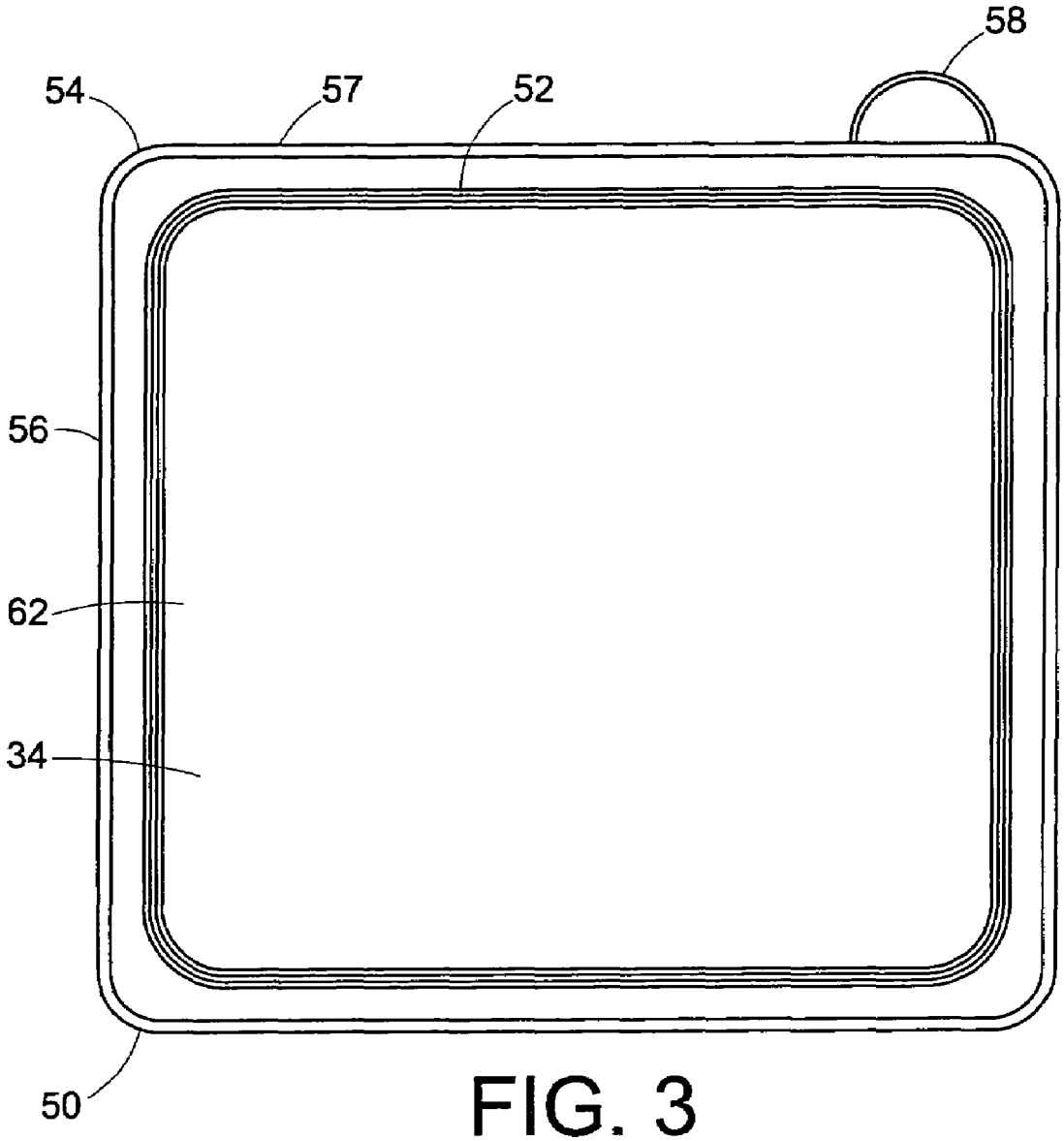
FIG. 3 is a front elevational view of the cover of FIG. 1.

Referring now to FIG. 3, cover 34 is used to sealingly engage the skimmer face plate. The cover has approximately the same outer dimensions as the skimmer plate. The cover is constructed of a flexible material such as a thermoplastic (i.e., polypropylene or the like), or any other suitable material. The cover is shown to be square in shape, and is sized to fit snugly around the peripheral edge 42 of the face plate. However, the cover and skimmer plate can be made of different shapes and dimensions without departing from the scope of the present invention.

Figure 5:
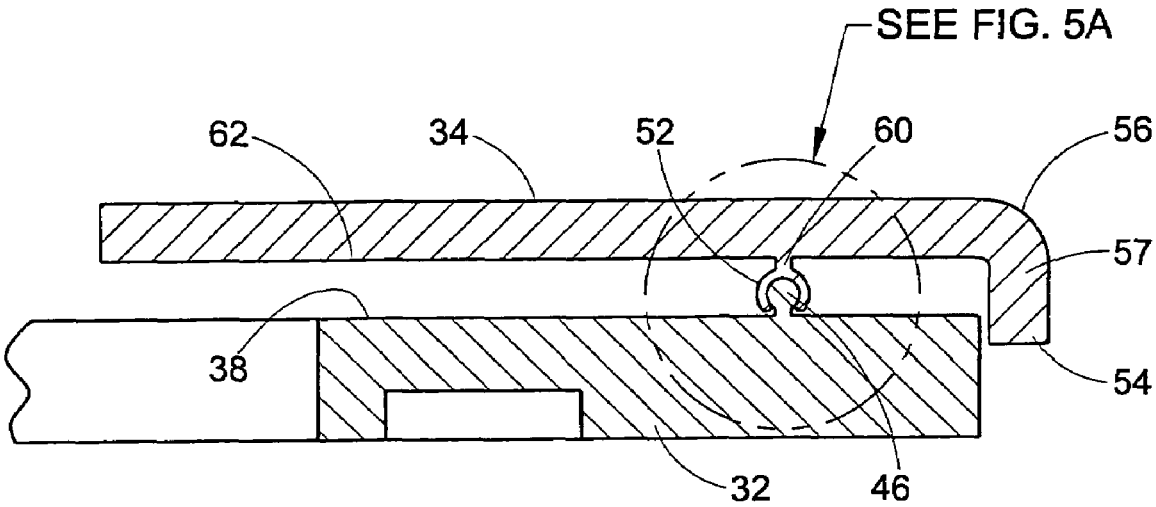
FIG. 5 is a cross-sectional side elevational view showing the cover and skimmer plate in mating engagement; and, FIG. 5A is an enlarged side elevational view of the sealing engagement structure of the cover and skimmer plate.

The cover further has a recess or groove portion 52 formed in planar wall 62 of the cover, which is formed to matingly engage the rib 46 of the skimmer plate. Wall 62 of the cover faces wall 38 of the face plate when the cover is installed over the face plate, as seen in FIG. 5. That is, the grooved portion is sized to substantially configure with the dimensions of the ribbed portion. FIG. 3 shows the grooved portion in a track of a generally square conformation, which matches the configuration of the track of rib 46. Other track shapes, such as rectangular or round, would also be within the scope of the invention.

The cover also has a lip or wall 57 on edge 54, which can be a rounded or straight edge, which extends from a peripheral edge 56 of the cover and corners 50 of the cover. The lip extends over edge 42 of the face plate when the cover is installed over the face plate. A handle 58 extends from the edge 56 of the cover for manually pulling or removing the cover with respect to the skimmer plate.

Figure 4:
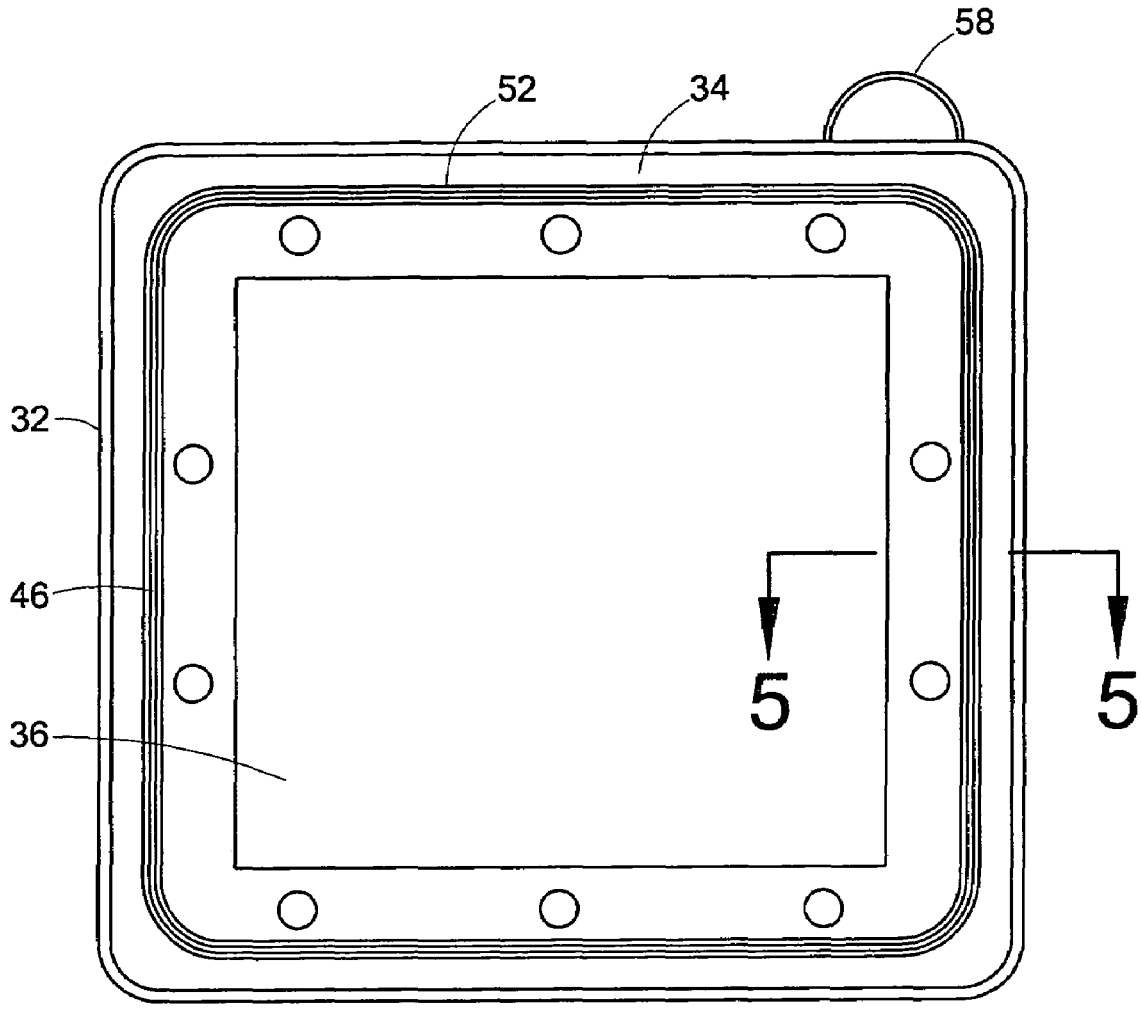
FIG. 4 is a front elevational view of the cover installed over the skimmer plate.

Referring to FIG. 4, the cover is shown in the fully closed position where it overlaps the skimmer plate and covers and seals plate opening 36. The groove portion 52 is aligned with and slidably and matingly receives the rib 46 of the plate.

Figure 5A:
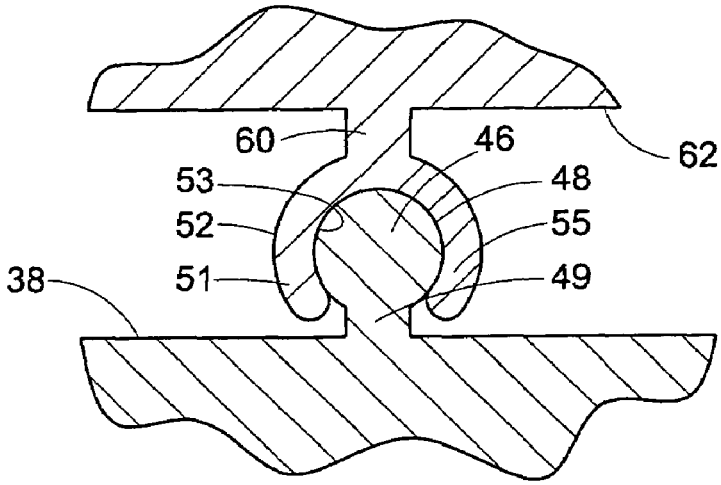

Referring to FIGS. 5 and 5A, the cover groove portion 52 can extend from a wall 60 which extends substantially perpendicular from planar wall 62 of the cover and also is formed in a square shaped track conformation. Rib 46 of the skimmer plate extends from wall 38 and forms a cooperating coupling structure with and is matingly received within the groove portion 52 which has a U-shaped or C-shaped opening or channel 53 formed between walls 51, 55 therein. The male (rib 46) and female (channel 53) interaction between the groove 52 and rib 46 is similar to that of zip lock or locking strips found on plastic bags such as shown in U.S. Pat. No. 7,029,178.

Thus, to install the cover plate onto the face plate, the groove portion 52 is aligned with the rib 46 of the face plate, preferably at a corner of the two plates. Then, using one's finger or thumb, manual pressure is applied along the length of the groove portion and rib so that the rib 46 becomes engaged with and locked within the channel 53 along the length of the groove portion to form a seal between the cover and the face plate.

The rib 46 has a first portion 48 which is slightly larger in dimension than a second portion 49 which extends from the planar wall 38 of the face plate. The first portion 48 becomes captured or locked within the channel 53 of the groove portion. First portion 48 of the rib is shown to be round in shape, and the channel 53 is shown to be substantially C-shaped. However, other shapes of the rib and channel can also be used without departing from the scope of the invention. The groove portion is formed of a resilient plastic and walls 51, 55 thereof can deflect slightly to release the rib from the channel. After the entire length of the rib has been pressed into the channel, the cover plate is locked onto the face plate, in a similar manner to a zip-locking feature such as in plastic bags. Thus, the rib and channel form a single track sealing interface such as a zipper or zip-lock feature of plastic bags. The interaction of the groove and rib is smoother and allows easy installation and removal of the cover with respect to the skimmer plate as compared to existing designs which use snaps or fasteners.

The seal is a more efficient and tighter seal than that of the prior art covers which use the edges of the cover to seal the cover and face plate such as shown in U.S. Pat. No. 5,285,538. That is, the peripheral edge of the cover extends over the edge of the face plate and snaps into place, such as in a Tupperware® type bowl or container. However, over time, the edges of the cover tend to curl back, thus compromising the seal between the cover and face plate and allowing water to enter back into the skimmer.

In contrast, the present invention utilizes a seal between two flat surfaces inwardly of the peripheral edges of the cover and face plate, resulting in a stronger and tighter seal, which will not weaken over time and prevent water from entering the skimmer. The application of the cover and face plate can be used in any application where a tight seal over an inlet is required.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A skimmer door assembly for use with an associated skimmer having an opening therein, comprising:

a face plate for matingly engaging said skimmer around said opening of said skimmer, said face plate having an opening therein which communicates with said opening of said skimmer, and a first locking member extending around a periphery of said opening of said face plate; and a cover which comprises a first, planar wall section which closes said opening of said face plate, and a second wall section extending substantially perpendicular from an end of said first planar wall section, said cover comprising a second locking member formed in said first, planar wall section, said second locking member comprises a wall extending from said first planar wall section, and a first portion and a second portion which form an opening therebetween; wherein each of said first and second portions extend from said wall of said second locking member, wherein said second locking member is spaced inwardly from said second wall section of said cover, wherein said second locking member engages said first locking member of said face plate for sealing said face plate to prevent water from entering said opening of said face plate.

2. The skimmer door assembly of claim 1, wherein said first locking member comprises a raised rib portion.

3. The skimmer door assembly of claim 2, wherein said second locking member comprises a grooved portion formed by said first and second portions.

4. The skimmer door assembly of claim 3, wherein said grooved portion is formed inwardly of a peripheral edge of said cover.

5. The skimmer door assembly of claim 3, wherein said raised rib portion and said grooved portion form a single track seal around said opening of said face plate.

6. The skimmer door assembly of claim 5, wherein said rib portion is manually pressed into engagement with said grooved portion.

7. The skimmer door assembly of claim 3, wherein said grooved portion is substantially C-shaped.

8. The skimmer door assembly of claim 2, wherein said rib portion is formed inwardly of a peripheral edge of said face plate.

9. The skimmer door assembly of claim 1, wherein said cover is fabricated of thermoplastic material.

10. The skimmer door assembly of claim 1, wherein said cover comprises a handle for removing said cover from said face plate.

11. A skimmer and door assembly, comprising:

a skimmer body having an inlet on a first end and an outlet on a second end;

a skimmer face plate having a frame having an opening therein which communicates with said inlet of said skimmer body; and, a cover plate which selectively covers said opening of said face plate and said inlet of said skimmer body, wherein said cover plate and said face plate comprise a single track sealing interface formed inwardly of a peripheral edge of said cover plate and inwardly of a peripheral edge of said face plate; wherein said cover plate further comprises a first wall which comprises a planar surface and a second wall which extends from said first wall, and first and second portions extending from said second wall forming a substantially C-shaped opening therebetween, and a third wall and fourth wall extending perpendicular to said first wall on opposite ends of said first wall.

12. The skimmer and door assembly of claim 11, wherein said single track sealing interface comprises a grooved member formed on said cover plate by said first and second portions and a rib member formed on said face plate.

13. The skimmer door assembly of claim 12, wherein said rib member is manually pressed into engagement with said groove member.

14. The skimmer door assembly of claim 11, wherein said cover plate third and fourth walls extend over a peripheral edge of said face plate.

15. The skimmer door assembly of claim 11, wherein said cover plate is fabricated of thermoplastic material.

16. The skimmer door assembly of claim 11, wherein said cover plate comprises a handle for removing said cover plate from said skimmer face plate.

17. A method of sealing an opening of a skimmer assembly used with a swimming pool or spa, comprising the steps of:

providing a face plate having a rib extending around a central opening within said face plate;

attaching a face plate to an inner wall of a swimming pool or spa;

providing a cover plate having a first wall with a planar surface and a second wall extending from an edge of said first wall, substantially perpendicular to said planar surface, and a third wall extending from said planar surface inboard from said second wall, said third wall has a first portion and second portion which form a circular groove therebetween; and manually pressing said rib of said face plate along a length of said rib into said groove of said cover plate to seal said face plate central opening and cover said tab and groove with said portions of said cover plate.

* * * * *